US007830091B2

(12) United States Patent
Suzuki et al.

(10) Patent No.: US 7,830,091 B2
(45) Date of Patent: Nov. 9, 2010

(54) PLASMA DISPLAY PANEL

(75) Inventors: Masanori Suzuki, Osaka (JP); Nobutaka Hokazono, Osaka (JP); Kentaro Ueda, Osaka (JP); Toshifumi Nagino, Osaka (JP)

(73) Assignee: Panasonic Corporation, Osaka (JP)

( * ) Notice: Subject to any disclaimer, the term of this patent is extended or adjusted under 35 U.S.C. 154(b) by 452 days.

(21) Appl. No.: 11/817,183

(22) PCT Filed: Dec. 26, 2006

(86) PCT No.: PCT/JP2006/325830

§ 371 (c)(1),
(2), (4) Date: Aug. 27, 2007

(87) PCT Pub. No.: WO2007/077803

PCT Pub. Date: Jul. 12, 2007

(65) Prior Publication Data

US 2009/0051288 A1 Feb. 26, 2009

(30) Foreign Application Priority Data

Dec. 27, 2005 (JP) ..... 2005-374459
Dec. 27, 2005 (JP) ..... 2005-374461
Dec. 27, 2005 (JP) ..... 2005-374462

(51) Int. Cl.
*H01J 17/49* (2006.01)

(52) U.S. Cl. ..... 313/582

(58) Field of Classification Search ..... 313/582–587, 313/292; 445/23–25; 345/41–42, 55, 60; 315/169.3, 169.4; 174/138 R
See application file for complete search history.

(56) References Cited

U.S. PATENT DOCUMENTS

2005/0017637 A1 * 1/2005 Kang et al. ..... 313/582
2007/0241681 A1 * 10/2007 Yoo et al. ..... 313/582

FOREIGN PATENT DOCUMENTS

JP 2003-131580 A 5/2003

* cited by examiner

*Primary Examiner*—Joseph L Williams
*Assistant Examiner*—Brenitra M Lee
(74) *Attorney, Agent, or Firm*—RatnerPrestia

(57) ABSTRACT

A plasma display panel includes a front panel and a rear panel. The front panel includes a front substrate and a display electrode. The rear panel includes a rear substrate, a barrier rib, a data electrode, and a phosphor layer. The rear substrate is arranged while facing the front substrate to form a discharge space between the front panel and the rear substrate. The barrier rib is formed at the rear substrate to partition the discharge space, the data electrode is formed while intersecting the display electrode, and the phosphor layer is formed between the barrier ribs. The barrier rib is formed at the divided areas separately in a direction parallel to the data electrode, and the barrier ribs formed at the divided areas separately have different properties among the plurality of areas. A large-screen plasma display panel having a high-resolution display quality is easily realized by the above configuration.

5 Claims, 11 Drawing Sheets

PLASMA DISPLAY PANEL

This application is a U.S. National Phase Application of PCT International Application PCT/JP2006/325830, filed Dec. 26, 2006.

TECHNICAL FIELD

The present invention relates to a plasma display panel used as a display device of a plasma display apparatus.

BACKGROUND ART

Conventional plasma display panels used in plasma display apparatuses are divided broadly into an AC type and a DC type, different in driving mode. The plasma display panels are further divided into a surface discharge type and an opposing discharge type, different in discharge mode. In recent years, a dominating plasma display panel has been the 3-electrode surface discharge type one, because of its suitability for high resolution and for a large screen and of its easy fabrication.

The surface discharge type plasma display panel has a pair of substrates placed oppositely so as to form a discharge space therebetween. At least the front one of the substrates is transparent. Further, a barrier rib for dividing the discharge space into a plurality of spaces is disposed on the substrate. Each of the substrates has a group of electrodes disposed thereon so that discharges occur within the discharge spaces divided by the barrier rib. Phosphors for generating light of red, green and blue colors are disposed on the discharge spaces, and thereby the discharge spaces form a plurality of discharge cells. The phosphors are excited by vacuum ultraviolet light with short wave length generated by the discharge, so that the discharge cells having phosphors responsible for red, green and blue colors generate visible light of respective colors. Thus, the plasma display panel implements a full color display.

The plasma display panels have many advantages including their capability of high-speed display, a wider viewing angle, adaptability for upsizing, and higher display quality because of their self-luminous function, as compared to liquid crystal display panels. These features thus gain attention especially in recent years among various flat-panel displays, and many plasma display panels are used for a variety of purposes such as displays in public places where many people gather, and displays in private homes for family members to enjoy images on large screens.

In the conventional plasma display apparatus, the plasma display panel is secured to a front surface of a chassis base, and a circuit board is mounted to the backside of the chassis base. Thus, a module is formed. The plasma display panel includes glass as chief material, whereas the chassis base is made of metal, such as aluminum. A circuit board constitutes a driving circuit for lighting the plasma display panel. The conventional plasma display panel and the plasma display apparatus having the same therein are disclosed in Unexamined Japanese Patent Publication No. 2003-131580 (Patent Document 1) and others.

Patent Document 1: Unexamined Japanese Patent Publication No. 2003-131580.

DISCLOSURE OF THE INVENTION

The present invention provides a plasma display panel advantageously requiring no supersized manufacturing equipment, being low in manufacturing costs, maintaining a high manufacturing yield, and being suitable for a large screen and high resolution.

The plasma display panel of the present invention includes: a front panel having a front substrate and display electrodes; and a rear panel having a rear substrate, a barrier rib, a data electrode and a phosphor layer. The rear substrate faces the front substrate to form a discharge space therebetween. The barrier rib is disposed on the rear substrate to divide the discharge space. The data electrode intersects the display electrodes. The phosphor layer is disposed between the barrier ribs. The plurality of barrier ribs are formed at a plurality of divided areas in parallel to the data electrode by a divisional exposure method, and the plurality of barrier ribs formed in the plurality of divided areas have different properties at the boundary between the plurality of divided areas. This configuration easily provides a plasma display panel having a large screen and high resolution as display quality.

REFERENCE MARKS IN THE DRAWINGS

Figure 1:
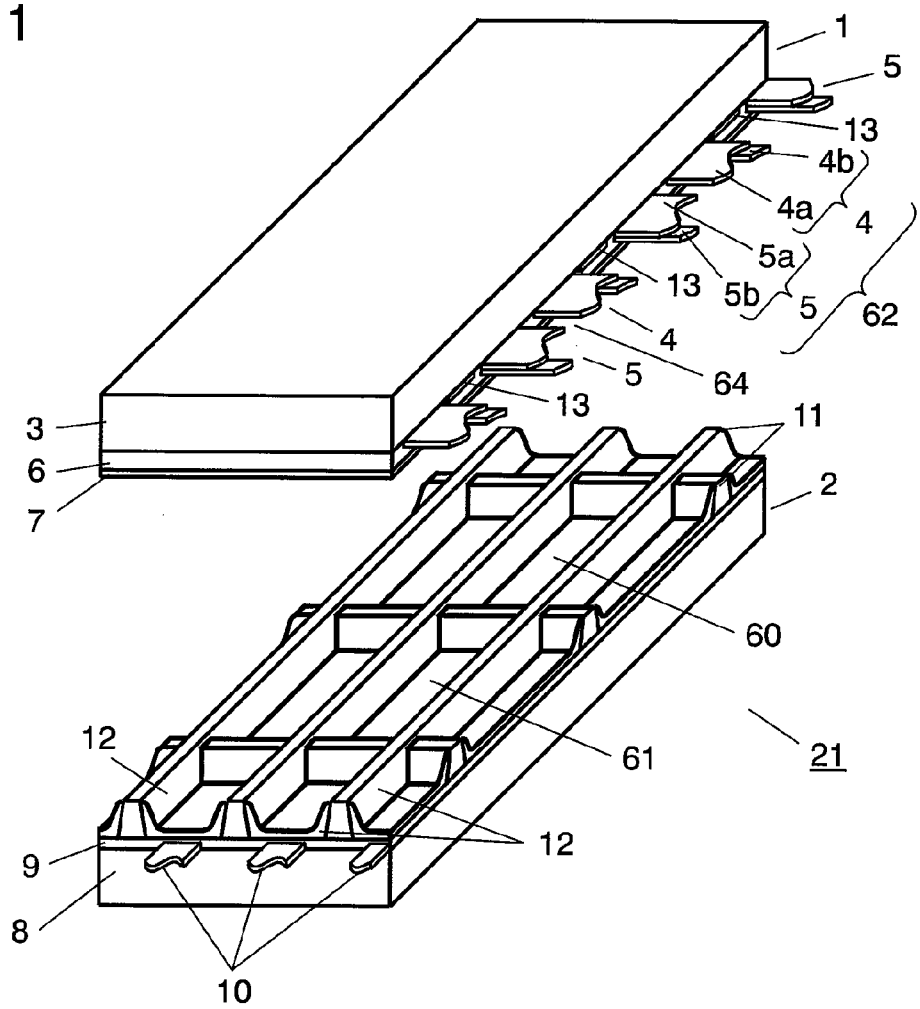
FIG. 1 is a schematic perspective view showing an essential part of a plasma display panel according to a first embodiment of the present invention.

1 front panel
1*a* and 2*a* alignment mark
1*b* and 2*b* boundary
2 rear panel
3 front substrate
4 scan electrode
4*a* and 5*a* transparent electrode
4*b* and 5*b* bus electrode
5 sustain electrode
6 dielectric layer
7 protective layer
8 rear substrate
9 insulating layer
10 data electrode
11, 11*c*, 11*e*, 11*f*, and 11*g* barrier rib
11*a*, 11*b*, and 11*h* vertex portion
12 phosphor layer
12R red phosphor layer
12G green phosphor layer
12B blue phosphor layer
13 light-shielding layer
21 plasma display panel
60 discharge space
61 discharge cell
62 display electrode
63 plasma display apparatus

PREFERRED EMBODIMENTS FOR CARRYING OUT OF THE INVENTION

Embodiments of the invention will be described below with reference to the drawings. The present invention is not limited to the following embodiments.

First Embodiment

A plasma display panel according to a first embodiment of the present invention is described hereinafter with reference to FIGS. 1 to 11.

First, the structure of the plasma display panel will be described with reference to FIG. 1. As shown in FIG. 1, plasma display panel 21 (herein after referred to as panel 21) has front panel 1 and rear panel 2 oppositely disposed so as to form discharge space 60 therebetween. Front panel 1 and rear panel 2 are sealed with each other by use of sealant (not shown) disposed on their peripherals. Discharge space 60 is filled with discharge gas. Thus, panel 21 is formed. A glass frit is used as the sealant, for example. Mixed gas of neon and xenon is used as the discharge gas, for example.

Front panel 1 includes front substrate 3 made of glass, and a plurality of display electrodes 62 arranged in parallel with each other on front substrate 3. Display electrode 62 has scan electrode 4 as the first electrode and sustain electrode 5 as the second electrode. A pair of scan electrode 4 and sustain electrode 5 are arranged in parallel so as to oppose each other with discharge gap 64 therebetween. Further, scan electrode 4 and sustain electrode 5 are covered with dielectric layer 6 made of glass. On dielectric layer 6, protective layer 7 made of MgO is formed. Thus, front panel 1 is configured. Scan electrode 4 has transparent electrode 4*a* and bus electrode 4*b* stacked on transparent electrode 4*a*. Likewise, sustain electrode 5 has transparent electrode 5*a* and bus electrode 5*b* stacked on transparent electrode 5*a*. Transparent electrodes 4*a* and 5*a* are each formed of ITO or the like and are optically transparent. Bus electrodes 4*b* and 5*b* each contain electrically conductive material, such as Ag, as a major constituent.

Back panel 2 includes rear substrate 8 which is made of glass and is facing front substrate 3, and a plurality of data electrodes 10 disposed on rear substrate 8. Data electrode 10 is made of electrically conductive material, such as Ag. Data electrode 10 is covered with insulating layer 9 made of glass. Further, barrier rib 11 is arranged on insulating layer 9 in a lattice form. Barrier rib 11 divides discharge space 60 into discharge cells 61. Phosphor layers 12 responsible for red, green and blue colors are disposed between barrier ribs 11. Thus, rear panel 2 is configured. Data electrode 10 is arranged between barrier ribs 11 so as to intersect scan electrode 4 and sustain electrode 5. This configuration forms discharge cells 61 at the intersections of scan electrodes 4 and sustain electrodes 5 with data electrodes 10. Discharge cells 61 are divided by barrier ribs 11.

Black light-shielding layers 13 having a high light-shielding effect are provided to improve contrast. Each light-shielding layer 13 is arranged between scan electrode 4 and sustain electrode 5.

The structure of panel 21 is not restricted to the structure described above. For example, panel 21 may have barrier ribs being in a stripe form. In terms of the arrangement of scan electrodes 4 and sustain electrodes 5, FIG. 1 shows display electrodes 62 having scan electrodes 4 and sustain electrodes 5 arranged alternately, in the order of scan electrode 4, sustain electrode 5, scan electrode 4, sustain electrode 5, and so on. Panel 21 may, however, have display electrode 62 having scan electrodes 4 and sustain electrodes 5 arranged in the order of scan electrode 4, sustain electrode 5, sustain electrode 5, scan electrode 4, and so on.

Figure 2:
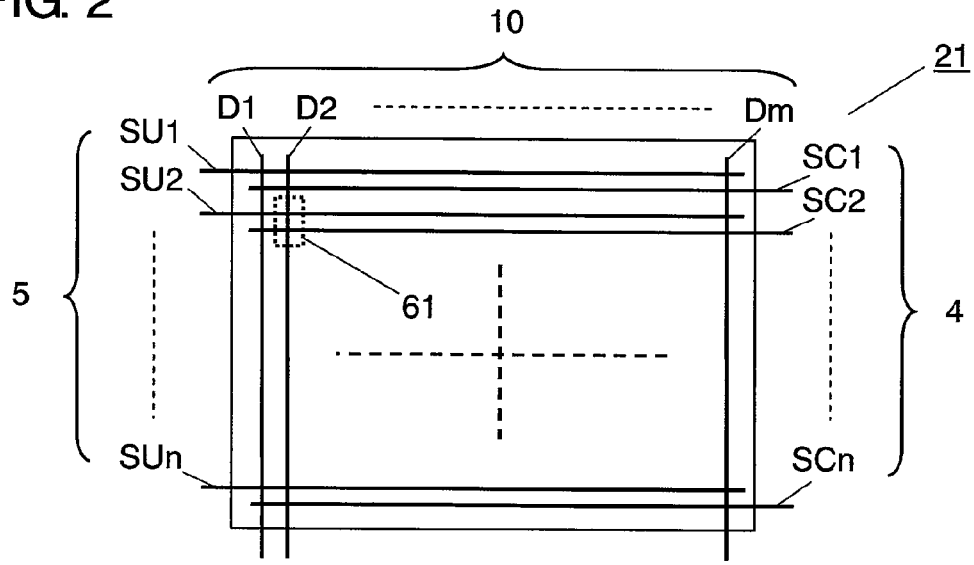
FIG. 2 is a schematic view showing an arrangement of electrodes in the plasma display panel shown in FIG. 1.

FIG. 2 is a schematic view showing an arrangement of the electrodes in the plasma display panel shown in FIG. 1. In a direction of columns (i.e., vertically in FIG. 2), n scan electrodes 4, i.e., scan electrodes SC1 to SCn, and n sustain electrodes 5, i.e., sustain electrodes SU1 to SUn are arranged. On the other hand, in a direction of rows (i.e., horizontally in FIG. 2), m data electrodes 10, i.e., data electrodes D1 to Dm are arranged. Each discharge cell 61 is formed at the intersection of a pair of scan electrode SCi and sustain electrode SUi (where, "i" takes any of 1 to n) and data electrode Dj (where, "j" takes any of 1 to m). Thus, m×n discharge cells 61 are formed within discharge space 60.

Figure 3:
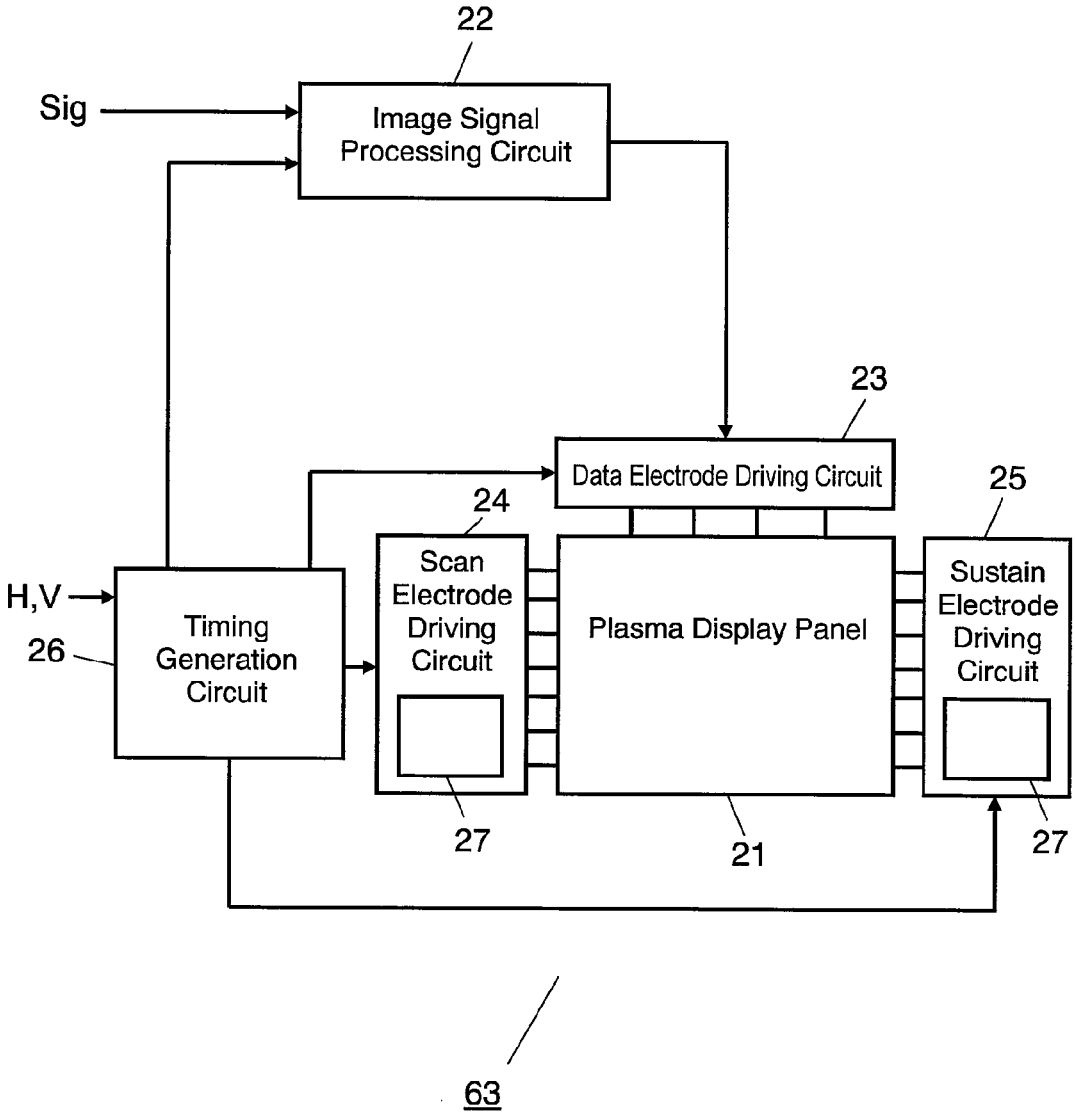
FIG. 3 is a circuit block diagram of a plasma display apparatus provided with the plasma display panel shown in FIG. 1.

FIG. 3 is a circuit block diagram of the plasma display apparatus provided with plasma display panel 21. Plasma display apparatus 63 includes panel 21, image signal processing circuit 22, data electrode driving circuit 23, scan electrode driving circuit 24, sustain electrode driving circuit 25, timing generation circuit 26, power source circuit (not shown), and others.

In FIG. 3, timing generation circuit 26 generates various timing signals according to horizontal synchronizing signal H and vertical synchronizing signal V, and feeds the generated signals into respective driving circuit blocks, i.e., image signal processing circuit 22, data electrode driving circuit 23, scan electrode driving circuit 24 and sustain electrode driving circuit 25. Image signal processing circuit 22 converts image signal Sig into image data corresponding to respective sub-fields. Data electrode driving circuit 23 converts the image data corresponding to each sub-field into signals corresponding to respective data electrodes D1 to Dm. Respective data electrodes D1 to Dm are driven by the signals converted by data electrode driving circuit 23. Scan electrode driving circuit 24 provides scan electrodes SC1 to SCn with driving voltage waveforms according to the timing signal fed by timing generation circuit 26. Likewise, sustain electrode driving circuit 25 provides sustain electrodes SU1 to SUn with driving voltage waveforms according to the timing signal fed by timing generation circuit 26. Scan electrode driving circuit 24 and sustain electrode driving circuit 25 each include sustain pulse generator 27.

Figure 4:
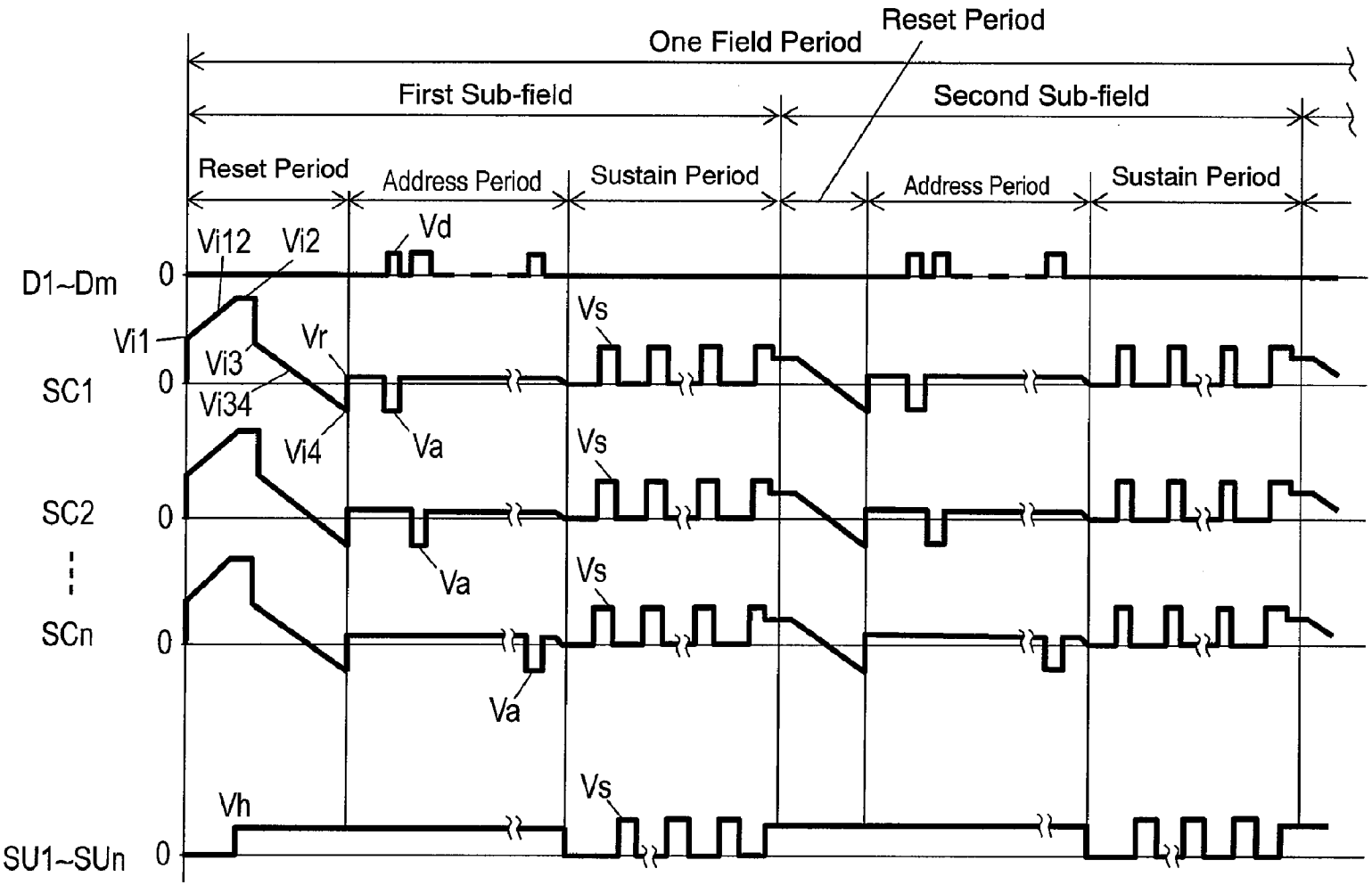
FIG. 4 is a waveform chart showing driving voltage waveform for driving the plasma display apparatus shown in FIG. 3.

Next, driving voltage waveforms for driving plasma display panel 21 and an operation of panel 21 will be described with reference to FIG. 4. FIG. 4 shows driving voltage waveforms applied to respective electrodes in the plasma display panel.

In the operation of plasma display apparatus 63, one display field is divided into a plurality of sub-fields; each subfield has a reset, address, and sustain period.

In the reset period within the first sub-field, data electrodes D1 to Dm and sustain electrodes SU1 to SUn are initially kept at 0 (V); meanwhile, ramp voltage Vi12 is applied to scan electrodes SC1 to SCn. Ramp voltage Vi12 mildly increases from voltage Vi1 (V) not higher than the discharge starting voltage, up to voltage Vi2 (V) higher than the discharge starting voltage. During this process, a minor first-time reset discharge occurs at all of discharge cells 61. As a result, a negative wall voltage builds up on scan electrodes SC1 to SCn, while a positive wall voltage builds up on sustain electrodes SU1 to SUn and data electrodes D1 to Dm. The wall voltage on electrodes represents a voltage generated by the wall charges accumulated on dielectric layer 6 or phosphor layer 12, which are disposed over the electrodes.

Thereafter, sustain electrodes SU1 to SUn are maintained at positive voltage Vh (V); meanwhile, a ramp voltage Vi34 is applied to scan electrodes SC1 to SCn. Ramp voltage Vi34 mildly decreases from voltage Vi3 (V) to voltage Vi4 (V). During this process, a minor second-time reset discharge occurs at all of discharge cells 61. As a result, the wall voltages on scan electrodes SC1 to SCn and sustain electrodes SU1 to SUn are lessened, and the wall voltage on data electrodes D1 to Dm is properly controlled for the addressing.

In the address period within the first sub-field, firstly, scan electrodes SC1 to SCn are maintained at voltage Vr (V). Next, negative scan pulse voltage Va (V) is applied to scan electrode SC1 located at the first row; meanwhile, positive address pulse voltage Vd (V) is applied to data electrode Dk (where, "k" takes any of 1 to m) among data electrodes D1 to Dm. Data electrode Dk corresponds to discharge cell 61 that is to show the image signal on the first row. At the intersection of data electrode Dk and scan electrode SC1, the wall voltage on data electrode Dk and the wall voltage on scan electrode SC1 are added to externally applied voltage (Vd−Va) (V). Consequently, the voltage at the intersection exceeds the discharge starting voltage, so that an address discharge occurs between data electrode Dk and scan electrode SC1, and also between sustain electrode SU1 and scan electrode SC1. This address discharge causes the positive wall voltage to build up on scan electrode SC1, the negative wall voltage on sustain electrode SU1, and the negative wall voltage on data electrode Dk at discharge cell 61 that has undergone the address discharge.

In this way, some of discharge cells 61 that are to show the image signal on the first row undergo the address discharge, so that the wall voltages build up on the respective electrodes. Thus, an address operation for those discharge cells 61 is performed. On the other hand, the voltage does not exceed the discharge starting voltage at the intersection of some of data electrodes D1 to Dm that the address pulse voltage Vd (V) is not applied to and scan electrode SC1, and therefore, does not cause the address discharge. In the same manner, the addressing operation is performed raw-by-raw. When discharge cells 61 on the last row are addressed, the address period within the first sub-field is completed.

Next, in the sustain period within the first sub-field, positive sustain pulse voltage Vs (V) as the first voltage is applied to scan electrodes SC1 to SCn, and meanwhile, the ground voltage, i.e., 0 (V) as the second voltage is applied to sustain electrodes SU1 to SUn. At discharge cell 61 that has undergone the address discharge during the address period, sustain pulse voltage Vs (V) is added to each wall voltage on scan electrode SCi and sustain electrode SUi; consequently, the voltage between the voltage on scan electrode SCi and the voltage on sustain electrode SUi exceeds the discharge starting voltage. As a result, the sustain discharge occurs between scan electrode SCi and sustain electrode SUi, and ultraviolet light generated by the sustain discharge excites phosphor layer 12 to generate visible light. Further, the sustain discharge causes the negative wall voltage to build up on scan electrode SCi and the positive wall voltage on sustain electrode SUi and data electrode Dk.

At discharge cell 61 that underwent no address discharge during the address period, no sustain discharge occurs, so that the wall voltage at the end of the reset period is maintained. Following the sustain discharge, 0 (V) as the second voltage is applied to scan electrodes SC1 to SCn; meanwhile, sustain pulse voltage Vs (V) as the first voltage is applied to sustain electrodes SU1 to SUn. As a result, the voltage between sustain electrode SUi and scan electrode SCi exceeds the discharge starting voltage at discharge cell 61 that previously underwent the sustain discharge, causing the sustain discharge between sustain electrode SUi and scan electrode SCi again. This sustain discharge causes the negative wall voltage to build up on sustain electrode SUi and the positive wall voltage on scan electrode SCi.

Thereafter, sustain pulse voltage Vs (V) is, in the same manner, alternately applied to scan electrodes SC to SCn and sustain electrodes SU1 to SUn. The number of applying sustain pulse voltage Vs (V) is weighed by luminance. In this way, the sustain discharge occurs successively at discharge cell 61 that underwent the address discharge during the address period. Thus, the sustain operation during the sustain period is completed.

In the second sub-field following the first one, the operations during the reset, address and sustain periods are generally the same as those in the first sub-field. Further, the operations in the third and later sub-fields are also generally the same. Therefore, description is omitted on the operations in the second and later sub-fields.

Figure 5:
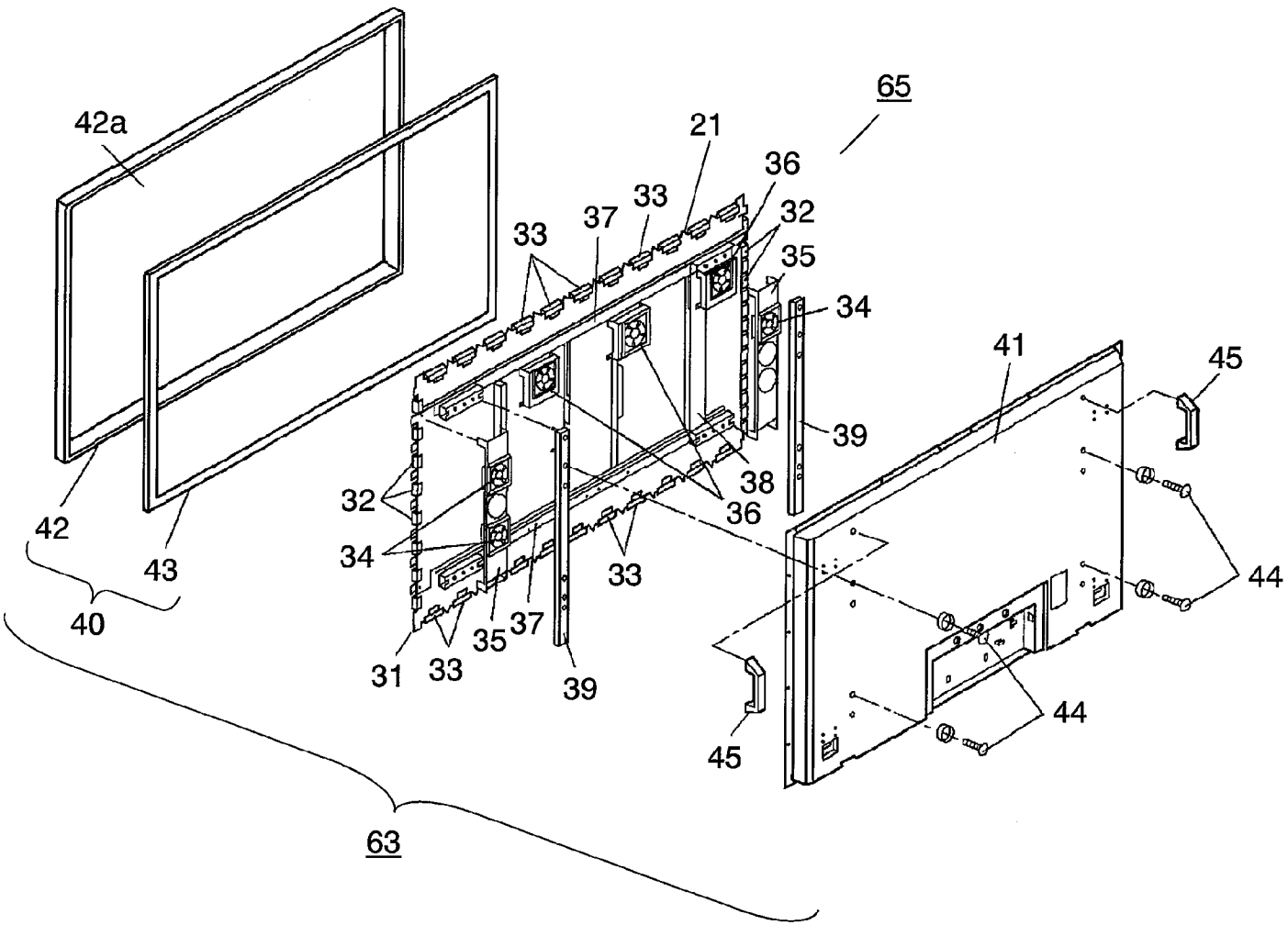
FIG. 5 is an exploded perspective view schematically showing an overall structure of the plasma display apparatus provided with the plasma display panel shown in FIG. 1.

Next, description will be given with reference to FIG. 5 on an overall structure of plasma display apparatus 63 in which plasma display panel 21 is built in. FIG. 5 is an exploded perspective view schematically showing the overall structure of the plasma display apparatus provided with the plasma display panel of the present invention.

In FIG. 5, chassis base 31, made of metal, such as aluminum, serves both as a holder plate and a heat sink plate. Panel 21 is held on a front side of chassis base 31. Panel 21 and chassis base 31 are bonded by use of an adhesive (not shown) or the like with a heat sink sheet (not shown) interposed therebetween. A plurality of driving circuit blocks (not shown) are disposed on a back side of chassis base 31. The driving circuit blocks drive plasma display panel 21 to show the image. Module 65 is thus configured. In FIG. 5, panel 21, being behind chassis base 31, is not shown.

The heat sink sheet is provided so as for panel 21 to keep close contact with and be held on the front side of chassis base 31, and thereby conducts and dissipates the heat generated by panel 21 to chassis base 31. The heat sink sheet is about 1 mm to 2 mm in thickness, for example. The heat sink sheet is formed of an electrically insulative sheet composed of synthetic resin, such as acryl resin, polyurethane resin, silicone resin and silicone rubber, with filler contained therein to improve heat conductivity. The heat sink sheet may instead be formed of a graphite sheet or a metal sheet. Further, the heat sink sheet itself may have adhesivity so as for panel 21 to be bonded with and held by chassis base 31 without adhesive. Alternatively, the heat sink sheet having no adhesivity may bond panel 21 and chassis base 31 via a double-sided adhesive tape.

Around both side edges of panel 21, are there disposed flexible wiring sheets 32 as display electrode wiring components that are connected with leading conductors of scan electrodes 4 and sustain electrodes 5. Flexible wiring sheets 32 extend over an outer periphery of chassis base 31 to the back side thereof, and are connected with a driving circuit block (not shown) corresponding to scan electrode driving circuit 24 and a driving circuit block (not shown) corresponding to sustain electrode driving circuit 25 via respective connectors.

On the other hand, around a top edge and a bottom edge of panel 21, are there disposed a plurality of flexible wiring sheets 33 as data electrode wiring components that are connected with leading conductors of data electrodes 10. Flexible wiring sheets 33 are electrically connected with a plurality of data drivers in data electrode driving circuit 23. Flexible wiring sheets 33 also extend over the outer periphery of chassis base 31 to the back side thereof, and are electrically connected with driving circuit blocks (not shown) in data electrode driving circuit 23. The driving circuit blocks in data electrode driving circuit 23 are disposed at an upper position and a lower position on the back side of chassis base 31.

In the vicinity of the respective driving circuit blocks, cooling fans 34, supported by angle frames 35, are arranged. Air flows from cooling fans 34 cool the respective driving circuit blocks. At the upper position of chassis base 31, three cooling fans 36 are arranged. Cooling fans 36 cool the driving circuit block in data electrode driving circuit 23 that is disposed at the upper position of chassis base 31. Cooling fans 36 also generate an air flow running through the entire internal space of plasma display apparatus 63 from the bottom to the top along the back side of chassis base 31. This air flow cools an interior of plasma display apparatus 63.

Further, on chassis base 31, horizontal angle frames 37 and vertical angle frames 38 are secured for mechanical reinforcement. On angle frames 37, stand poles 39 are rigidly mounted by use of machine screws (not shown) to hold plasma display apparatus 63 standing upright.

Module 65, with the structure described above, is housed in an enclosure having front protection cover 40 placed on the front side of panel 21 and metal back cover 41 placed on the back side of chassis base 31. Thus, plasma display apparatus 63 is completed. Front protection cover 40 has front frame 42 and protection plate 43. Front frame 42 has opening 42*a*, and is composed of resin, metal or the like. Opening 42*a* is provided to expose an image display area on the front side of panel 21. Protection plate 43, made of glass or the like and optically transparent, is provided in opening 42*a*. Protection plate 43 is, for example, provided with an electromagnetic interference suppression film or an optical filter to suppress undesired emission of electromagnetic waves. Protection plate 43 is mounted inside front frame 42 with the periphery of protection plate 43 held by protection plate clamps (not shown) and the periphery of opening 42*a*. Besides, back cover 41 is provided with a plurality of vent openings (not shown) for dissipating heat generated by module 65.

As shown in FIG. 5, back cover 41 is secured to chassis base 31 by use of mechanical screws 44. On back cover 41, handles 45 are secured by use of mechanical screws (not shown) or the like. Handles 45 are used to carry plasma display apparatus 63.

Next, description will be given on the characteristics of the present invention to implement plasma display panel 21 having a large screen.

Use of exposure and development processes are effective to form the components, such as scan electrode 4, sustain electrode 5, data electrode 10, light-shielding layer 13 and barrier rib 11, on panel 21 in high precision. First, a photosensitive layer is formed on a substrate. Then the photosensitive layer is exposed to light via a photomask that allows a predetermined pattern to be drawn on. After being exposed, the photosensitive layer is developed. This development forms a highly precise pattern on the substrate. The advancing growth in screen size of the plasma display panel has, however, come to require such a large-sized plasma display panel that a broader area has to be exposed to light than an exposure area covered by an ordinary exposure device. To expose such a large-sized plasma display panel to light, a divisional exposing method is effective. The method divides the exposure area into a plurality of sub-areas and exposes the sub-areas to light one-by-one.

FIGS. 6A to 6D show the divisional exposure method used for easily manufacturing panel 21 of the present invention having a large screen. The figures specifically show the exposure method that exposes photosensitive layer 52 coated on substrate 51 to light via photomask 53.

Figure 6A:
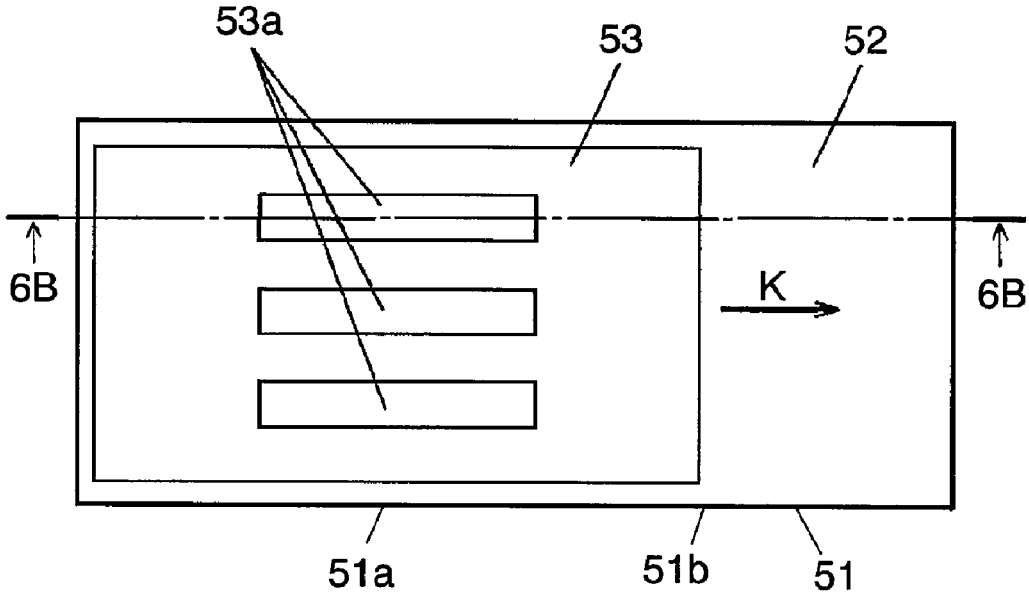
FIG. 6A is an explanatory view showing a divisional exposure method used in manufacturing the plasma display panel shown in FIG. 1.
Figure 6B:
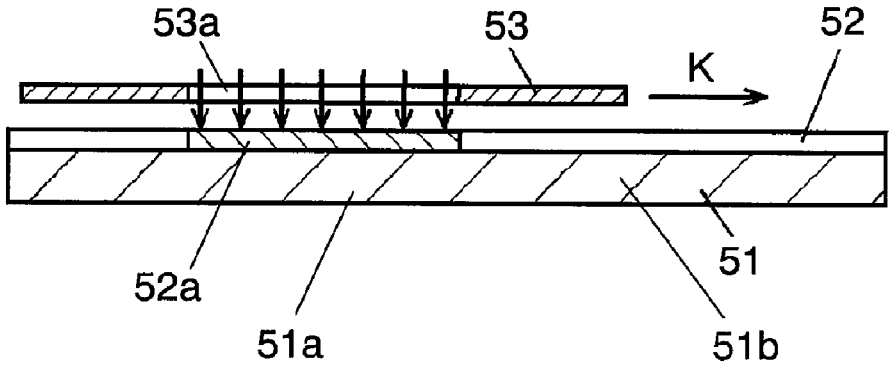
FIG. 6B is a schematic cross-sectional view showing the plasma display panel shown in FIG. 6A taken from a line 6B-6B.
Figure 6C:
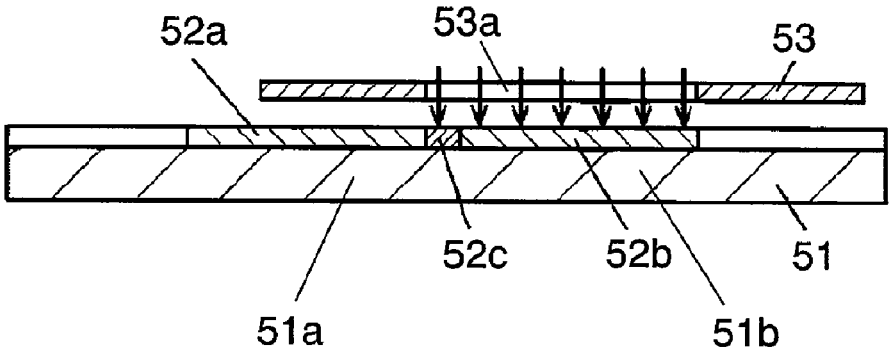
FIG. 6C is a schematic cross-sectional view showing the plasma display panel shown in FIG. 6A.
Figure 6D:
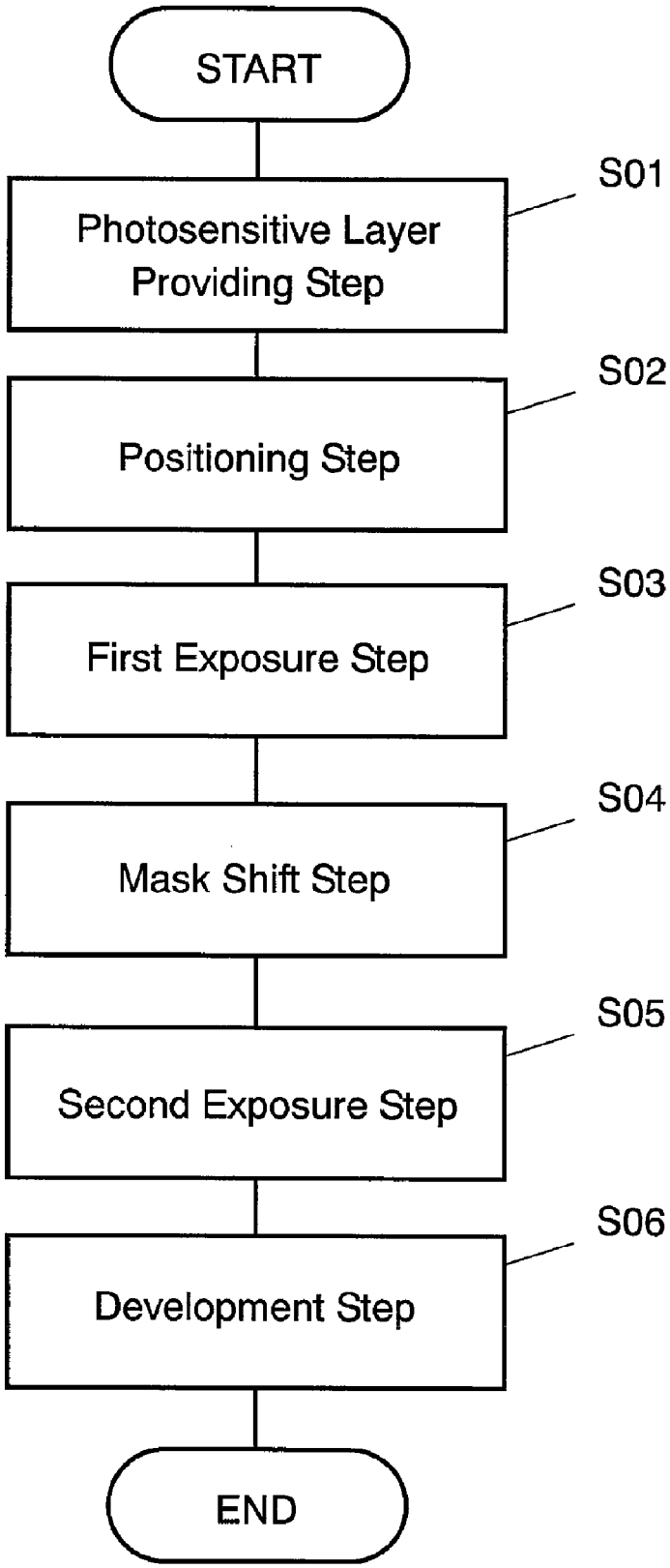
FIG. 6D is a flowchart showing a manufacturing method of the plasma display panel shown in FIG. 1.

FIG. 6A is a schematic plan view showing substrate 51, a left area of which is undergoing exposure to light. FIG. 6B is a schematic cross-sectional view showing substrate 51 taken from line 6B-6B of FIG. 6A. FIG. 6C is a schematic cross-sectional view showing substrate 51, a right area of which is undergoing exposure to light. Further, FIG. 6D is a flowchart showing steps of exposing and developing substrate 51.

First, at photosensitive layer providing step S01, photosensitive layer 52, made of silver paste or the like for forming a component of plasma display panel 21, is provided on substrate 51.

Next, at positioning step S02, substrate 51 having photosensitive layer 52 is positioned in relation to the exposure device (not shown).

At first exposure step S03, photosensitive layer 52 on left area 51*a* of substrate 51 is exposed to light by a light source (not shown) provided above photomask 53. During this exposure, photomask 53 is placed over left area 51*a* of substrate 51 at a preset height from photo sensitive layer 52. Photomask 53 is provided with opening 53*a*, and thereby allows the left area of photosensitive layer 52 to be selectively exposed in left exposure pattern 52*a*.

Further, at mask shift step S04, photomask 53 is shifted and placed over right area 51*b* of substrate 51 at the preset height from photosensitive layer 52.

At second exposure step S05, photosensitive layer 52 on right area 51*b* of substrate 51 is exposed to light by the light source provided above photomask 53, so that the right area of photosensitive layer 52 is selectively exposed in right exposure pattern 52*b*.

Moreover, at development step S06, photosensitive layer 52 exposed to light is developed, and thereby, an unexposed area in photosensitive layer 52 is removed so that components having predetermined patterns, such as patterned electrodes, are formed.

That is, since substrate 51 is sufficiently larger than photomask 53, substrate 51 is divided into two exposure areas as shown in FIG. 6A. The two exposure areas are exposed to light one-by-one with photomask 53 shifted in direction of arrow K, so that the entire area of substrate 51 is exposed. More specifically, substrate 51 undergoes the divisional exposure, which is divided into two steps: a step of exposing left area 51*a* of substrate 51 as shown in FIG. 6B, and a step of exposing right area 51*b* of substrate 51 as shown in FIG. 6C. Photomask 53 is provided with opening 53*a* to form the patterned electrodes and the like of the plasma display panel. Photosensitive layer 52 is exposed to light by the light source provided above photomask 53 via opening 53*a*. Linking portion 52*c* is twice exposed to light, i.e., at first exposure step S03 and at second exposure step S05. While left area 51*a* is exposed at first exposure step S03, right area 51*b* is shielded with a shield plate (not shown). Likewise, while right area 51*b* is exposed at second exposure step S05, left area 51*a* is shielded with the shield plate.

The divisional exposure method shown in FIGS. 6A to 6D relates a method of exposing left area 51*a* and right area 51*b* of substrate 51 separately by use of single photomask 53. Photomask 53 used for the divisional exposure of substrate 51 is, however, not necessarily single. For example, two different photomasks can be used: a left area photomask for exposing left area 51*a* and a right area photomask for exposing right area 51*b*.

The flowchart shown in FIG. 6D includes neither a step of drying photosensitive layer 52 nor a step of baking the same. The method is, however, not restricted to the flowchart shown in FIG. 6D. The method may rather include any step adequate to manufacture the plasma display panel, such as the drying step or the baking step.

When front panel 1 is manufactured, front substrate 3 is provided as substrate 51. Besides, when scan electrode 4 and sustain electrode 5 are formed as the components, material for composing scan electrode 4 and sustain electrode 5 is provided on front substrate 3 as photosensitive layer 52. When light-shielding layer 13 is formed as the component, material for composing light-shielding layer 13 is provided on front substrate 3 as photosensitive layer 52. Likewise, when rear panel 2 is manufactured, rear substrate 8 is provided as substrate 51. Besides, when data electrode 10 are formed as the components, material for composing data electrode 10 is provided on rear substrate 8 as photosensitive layer 52. When barrier rib 11 is formed as the component, material for composing barrier rib 11 is provided on rear substrate 8 as photosensitive layer 52.

Figure 7A:
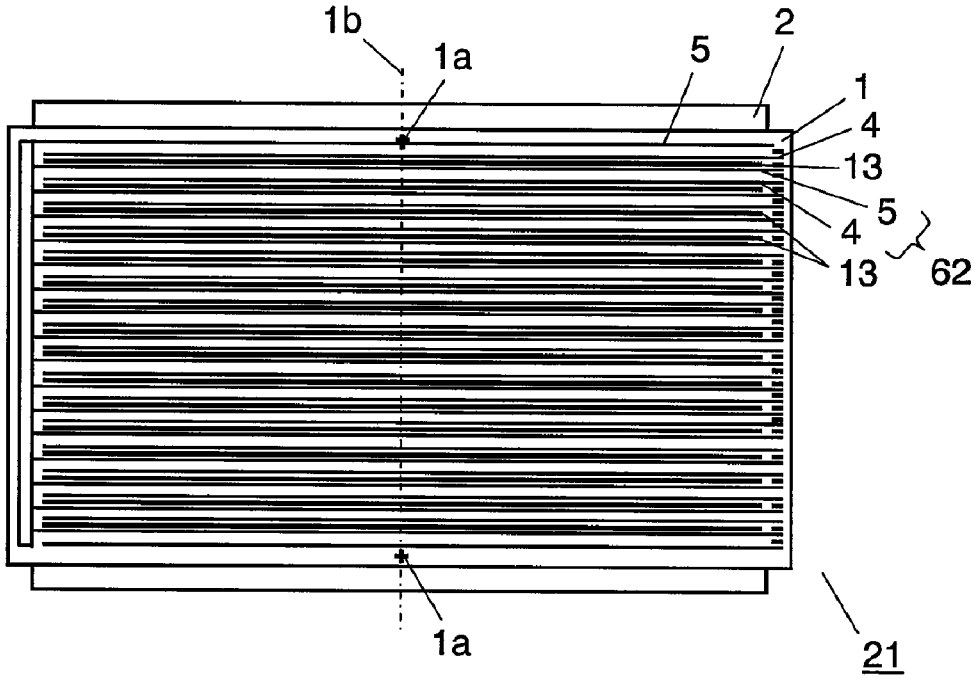
FIG. 7A is a schematic plan view showing the plasma display panel shown in FIG. 1 is viewed from its front panel.
Figure 7B:
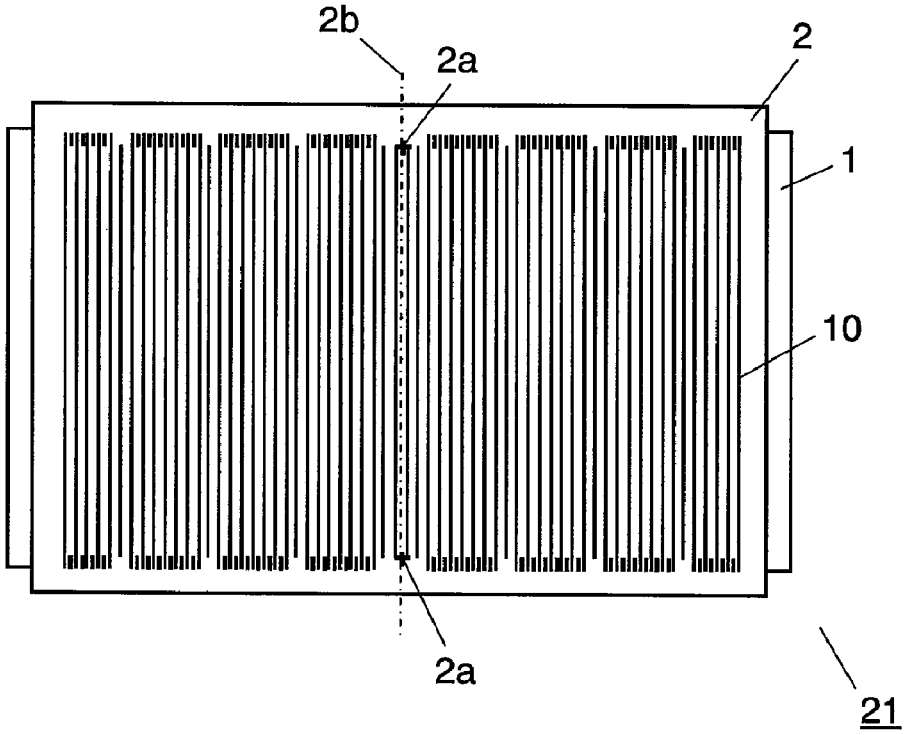
FIG. 7B is a schematic plan view showing the plasma display panel shown in FIG. 1 is viewed from its rear panel.

Next, FIG. 7A is a schematic plan view showing plasma display panel 21 viewed from front panel 1, where the plasma display panel 21 has the components formed by use of the divisional exposure method described above. FIG. 7B is a schematic plan view showing plasma display panel 21 viewed from rear panel 2.

As shown in FIG. 7A, cross-shaped alignment marks 1*a* are provided on front panel 1 at respective centers of a top edge portion and a bottom edge portion around a long side of front panel 1. Likewise, as shown in FIG. 7B, cross-shaped alignment marks 2*a* are provided on rear panel 2 at respective centers of a top edge portion and a bottom edge portion around a long side of rear panel 2. When the divisional exposure method is performed as shown in FIGS. 6A to 6D, alignment marks 1*a* and 2*a* are used to align front substrate 3 or rear substrate 8 as substrate 51 with photomask 53.

Alignment marks 1*a* may be formed of ITO on front substrate 3 simultaneously with transparent electrodes 4*a* and 5*a*. Likewise, alignment marks 2*a* may be formed of electrically conductive material, such as Ag, on rear substrate 8 simultaneously with data electrode 10.

As describe above, alignment marks 1*a* and 2*a* are provided at the respective centers of the top and bottom edge portions around the long sides of both front panel 1 and rear panel 2. Alignment marks 1*a* and 2*a* are used to align substrate 51 with photomask 53 in the steps of the divisional exposure method shown in FIGS. 6A to 6D. The components of plasma display panel 21 are, thereby, allowed to be exposed to light separately in respective divided areas so that the components are formed precisely. This results in plasma display panel 21 that maintains high display quality over a certain level in the respective divided areas. As a result, plasma display panel 21 having a large screen and high resolution, and plasma display apparatus 63 having the same therein are easily provided. Therefore, plasma display apparatuses 63 having a screen as large as 65 inches or more and also having high resolution as display quality (i.e., 1080×1920 or more) have been manufactured easily and at low costs, especially in recent years. In other words, there have been provided a plasma display panel 21 requiring no supersized manufacturing equipment, being low in manufacturing costs, maintaining a high manufacturing yield, and having a large screen and high resolution, plasma display apparatus 63 having plasma display panel 21 therein.

When the divisional exposure method described above is implemented to form each of the components of plasma display panel 21 in a divisional manner, boundaries 1*b* and 2*b* corresponding to linking portions 52*c* between the plurality of divided areas adversely affect the display quality in some case. That is, when plasma display apparatus 63 is viewed, certain shapes of boundaries 1*b* and 2*b* are visible to user's eyes so as to spoil the outside appearance of plasma display apparatus 63 during turning-on or off, also adversely affecting the display quality of plasma display apparatus 63. Plasma display panel 21 of the present invention has the following configuration.

In rear panel 2, boundary 2*b* is provided in the substantially central portion of the long side of rear panel 2 in a direction Y parallel to data electrode 10. Barrier rib 11 is formed at the divided areas separately in relation to boundary 2*b*. Barrier ribs 11 formed at the divided areas separately have different properties among plural areas. Examples of the property of barrier rib 11 include a geometrical property and an optical property. The geometrical property of barrier rib 11 includes. e.g., a shape of barrier rib 11. Examples of the shape of barrier rib 11 include a width and a height of barrier rib 11, a width of a vertex portion of barrier rib 11, and a pattern shape of barrier rib 11 when barrier rib 11 is observed in a planar manner. Examples of the optical property of barrier rib 11 include a reflectance and a light absorption property of barrier rib 11. Rear panel 2, used in plasma display panel 21 of the present invention, having the feature in the shape of barrier rib 11 will be described below with reference to FIGS. 8A to 11.

FIGS. 8A to 11 are views for explaining rear panel 2 which can be used for plasma display panel 21 of the present invention. Phosphor layer 12 includes red phosphor layer 12R, green phosphor layer 12G, and blue phosphor layer 12B.

Figure 8A:
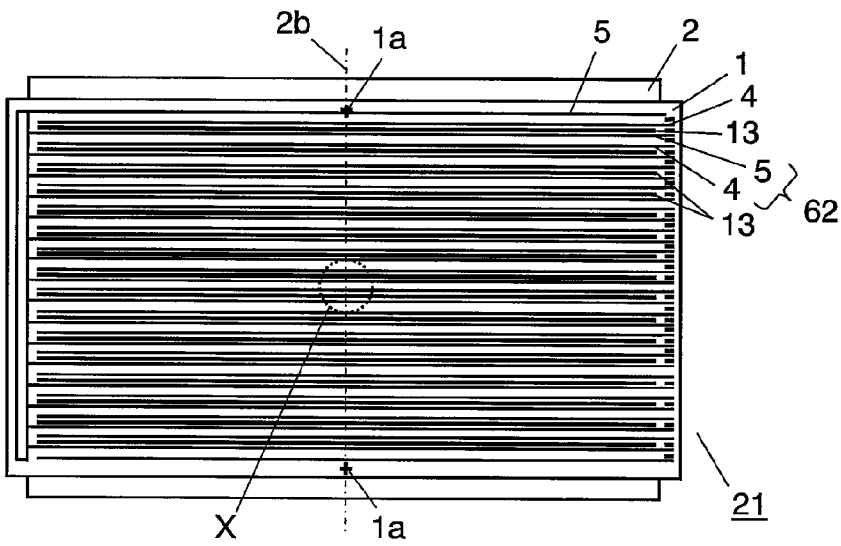
FIG. 8A is a schematic plan view showing the plasma display panel shown in FIG. 1 is viewed from its front panel.
Figure 8B:
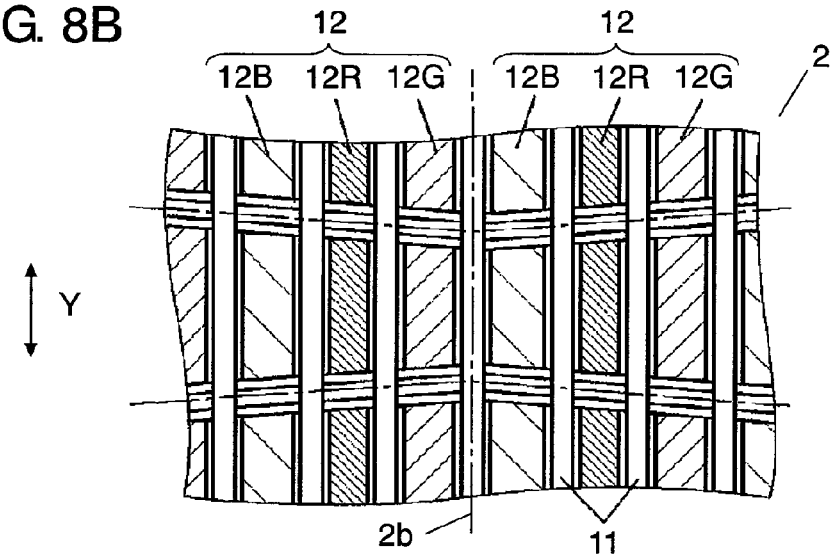
FIG. 8B is a partial enlarged plan view showing an essential part of a rear panel used for the plasma display panel shown in FIG. 8A.
Figure 8C:
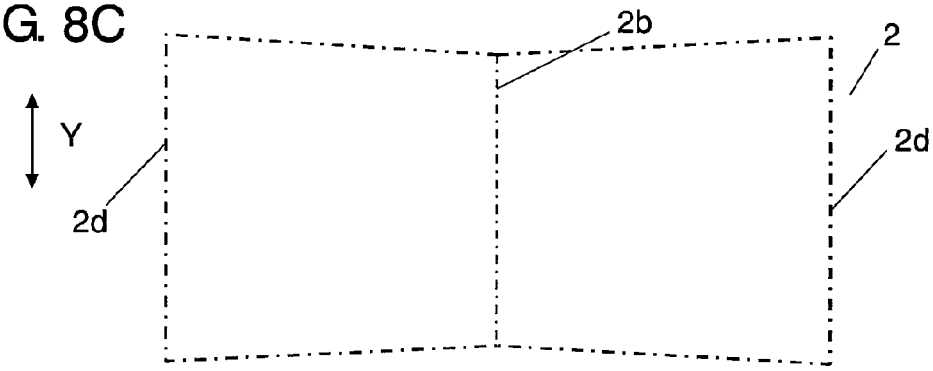
FIG. 8C is a schematic explanatory view showing the rear panel used for the plasma display panel shown in FIG. 1.

In an example shown in FIGS. 8A to 8C, boundary 2*b* is provided substantially at the center of rear panel 2. Barrier ribs 11 of right and left areas in relation to boundary 2*b* are inclined outward from the substantial center of boundary 2*b*. That is, as shown in FIG. 8C, when boundary 2*b* provided substantially at the center of rear panel 2 is compared to both end portions 2*d* of rear panel 2, rear panel 2 is formed in the pattern shape in which the widths of both end portions 2*d* are wider than that of boundary 2*b*. FIG. 8B is a partial enlarged plan view showing an essential part of an X portion which is of the substantial center of rear panel 2 shown in FIG. 8A.

Figure 9:
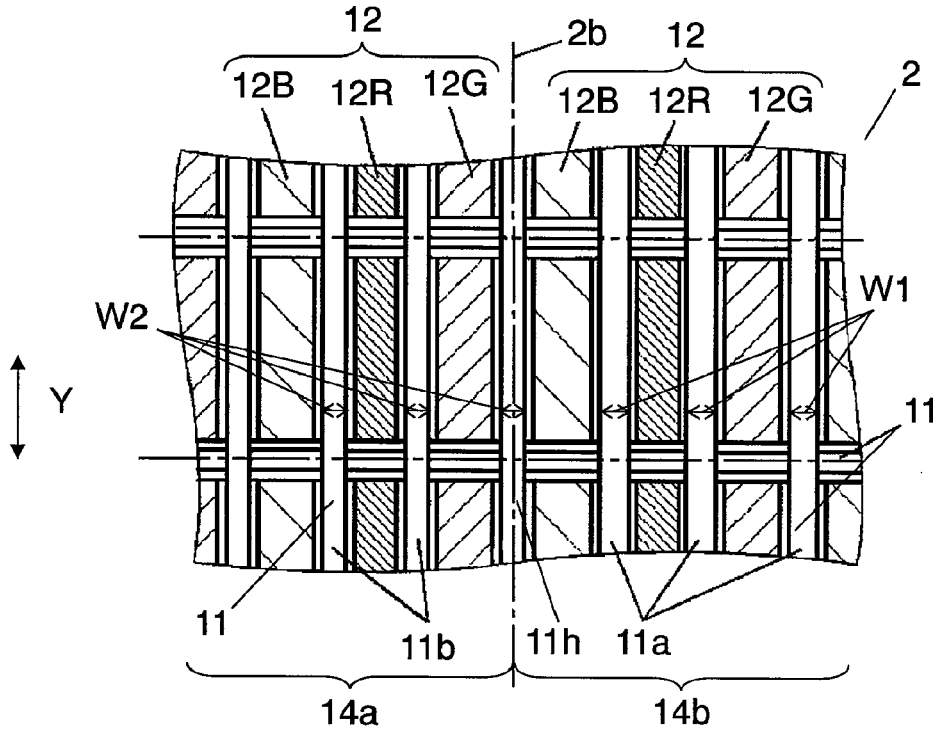
FIG. 9 is a partial enlarged plan view showing an essential part of a rear panel according to another embodiment used for the plasma display panel shown in FIG. 1.

Similarly, in an example of rear panel 2 shown in FIG. 9, boundary 2*b* is provided substantially at the center of rear panel 2. Barrier ribs 11 of the right and left areas in relation to boundary 2*b* are formed in the pattern shape in which vertex portions 11*a* and 11*b* differ from each other in the width. That is, rear panel 2 is formed such that a width W2 of vertex portion 11*b* of left area 14*a* is smaller than width W1 of vertex portion 11*a* of right area 14*b*. On the contrary, rear panel 2 may be formed such that a width W2 of vertex portion 11*b* of left area 14*a* is larger than width W1 of vertex portion 11*a* of right area 14*b*. In FIG. 9, the width of vertex portion 11*h* of barrier rib 11 provided in boundary 2*b* is equal to the width W2 of vertex portion 11*b* of left area 14*a*. However, it is not always necessary that the width of vertex portion 11*h* be equal to the width W2 of vertex portion 11*b*. For example, the width of vertex portion 11*h* may be equal to the width W1 of vertex portion 11*a* of right area 14*b*. Left area 14*a* constitutes a first area and right area 14*b* constitutes a second area.

Figure 10:
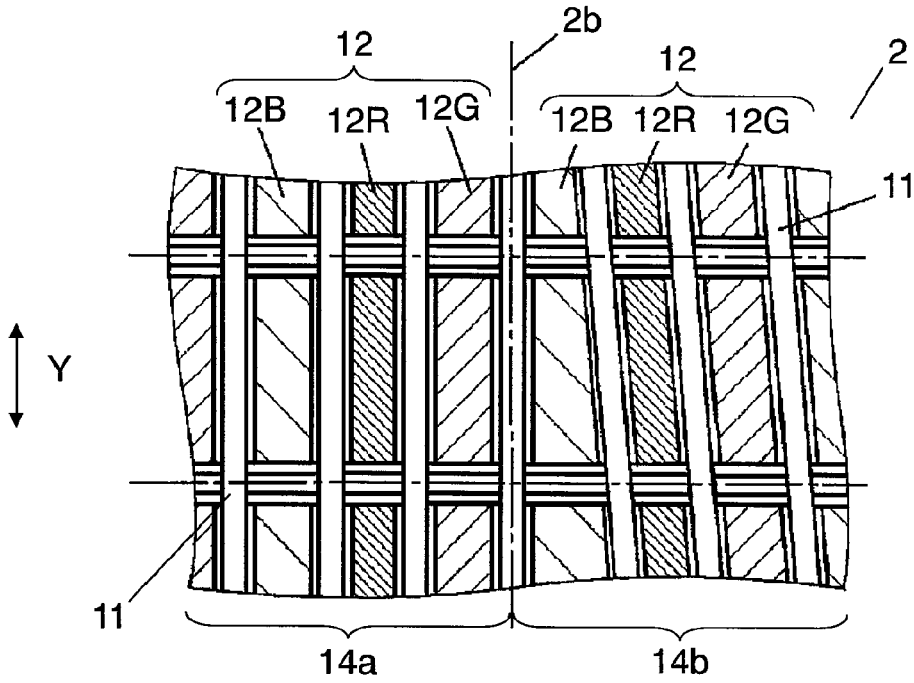
FIG. 10 is a partial enlarged plan view showing an essential part of a rear panel according to another embodiment used for the plasma display panel shown in FIG. 1.

In an example of rear panel 2 shown in FIG. 10, similarly boundary 2*b* is provided substantially at the center of rear panel 2. Rear panel 2 is formed in the pattern shape in which barrier rib 11 of right area 14*b* in relation to boundary 2*b* is inclined relative to barrier rib 11 of left area 14*a*. Barrier rib 11 of left area 14*a* is formed in substantially perpendicular to display electrode 62. Although not shown, barrier rib 11 of right area 14*b* may be formed substantially perpendicular to display electrode 62. In the case where barrier rib 11 is formed in the inclined pattern, data electrode 10 may also formed in the inclined pattern shape similar to barrier rib 11 according to an inclination angle of barrier rib 11. In this case, data electrode drive circuit 23 converts and generates the signal for driving data electrodes D1 to Dm in consideration of the inclined pattern shape of data electrode 10 or barrier rib 11.

Figure 11:
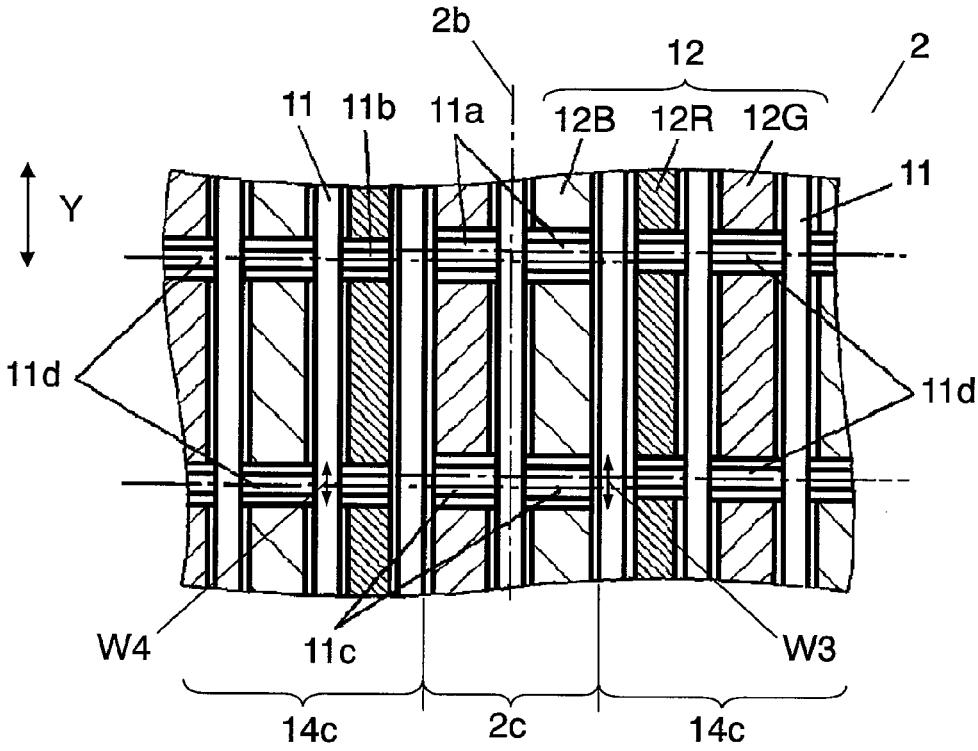
FIG. 11 is a partial enlarged plan view showing an essential part of a rear panel according to another embodiment used for the plasma display panel shown in FIG. 1.

In an example of rear panel 2 shown in FIG. 11, similarly boundary 2*b* is provided substantially at the center of rear panel 2. Boundary areas 2*c* which are of a third area are further provided on both sides of boundary 2*b*. Rear panel 2 is formed in the shape in which width W3 of crosswise barrier rib 11*c* of boundary area 2*c* is wider than width W4 of crosswise barrier rib 11*d* of fourth areas 14*c* except for boundary area 2*c*. Crosswise barrier ribs 11*c* and 11*d* shall mean barrier rib 11*c* and 11*d* formed in the direction parallel to the long side of rear panel 2, and barrier rib 11*c* and 11*d* formed in the direction intersecting data electrode 10. The barrier rib formed in parallel with data electrode 10 is called longitudinal barrier rib.

In FIG. 11, rear panel 2 is formed in the shape in which width W3 of crosswise barrier rib 11*c* of boundary area 2*c* is wider than width W4 of crosswise barrier rib 11*d* of fourth areas 14*c* except for boundary area 2*c*. However, the invention is not limited to rear panel 2 shown in FIG. 11. For example, rear panel 2 may be formed in the shape in which width W3 of crosswise barrier rib 11*c* of boundary area 2*c* is narrower than width W4 of crosswise barrier rib 11*d* of fourth areas 14*c* except for boundary area 2*c*.

In FIG. 11, boundary area 2*c* is illustrated as the area including barrier ribs 11 formed in boundary 2*b*, i.e., barrier ribs 11 of the three rows. However, boundary area 2*c* is not limited to the area including barrier ribs 11 of the three rows, but boundary area 2*c* may be the area including barrier ribs 11 of the five or seven rows. The width of boundary area 2*c* may appropriately be determined according to the properties of panel 21 such as the size and the resolution or the display quality.

Thus, in the case where rear panel 2 used in plasma display panel 21 is formed by the divided exposure method, the barrier ribs 11 are formed at the divided areas separately in the direction Y parallel to data electrode 10. Barrier ribs 11 formed at the divided areas separately have the different shapes in relation to boundary 2*b* between the plural areas. Therefore, in watching plasma display apparatus 63, boundary 2*b* is hardly recognized by the human eyes, and plasma display panel 21 in which predetermined display quality is maintained is easily realized. Large-screen, high-resolution plasma display apparatus 63 in which plasma display panel 21 is used is easily realized.

Second Embodiment

A plasma display panel according to a second embodiment of the present invention will be described with reference to FIGS. 12A to 12C. The plasma display panel of the second embodiment has the feature in the optical property of the barrier rib compared with the first embodiment. The plasma display panel of the second embodiment is similarly used in plasma display apparatus 63 described in the first embodiment, and the plasma display panel exerts the same action and effect. Accordingly, the same component as the first embodiment is designated by the same numeral, and the detailed description is omitted.

Figure 12A:
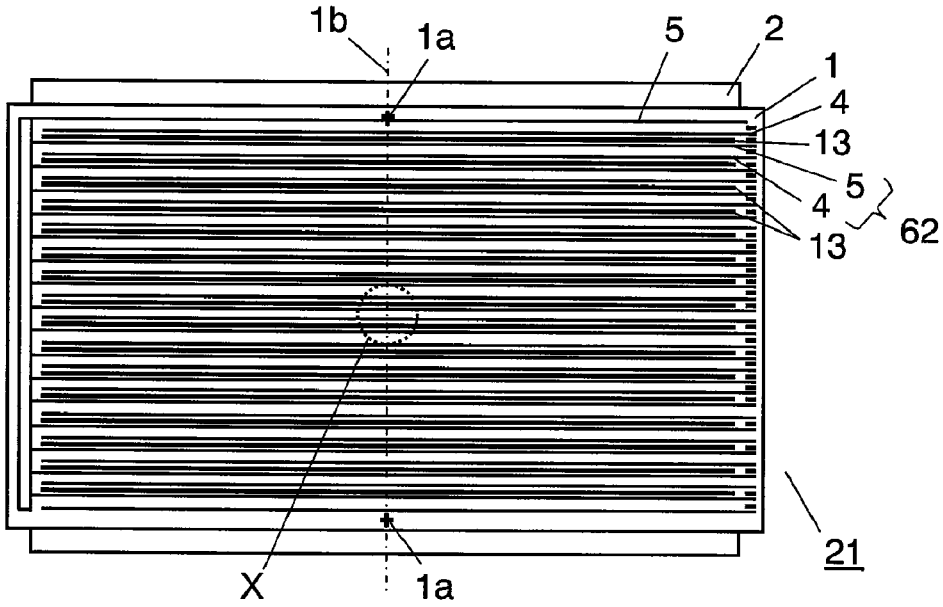
FIG. 12A is a schematic plan view showing a plasma display panel according to a second embodiment of the present invention is viewed from its front panel.
Figure 12B:
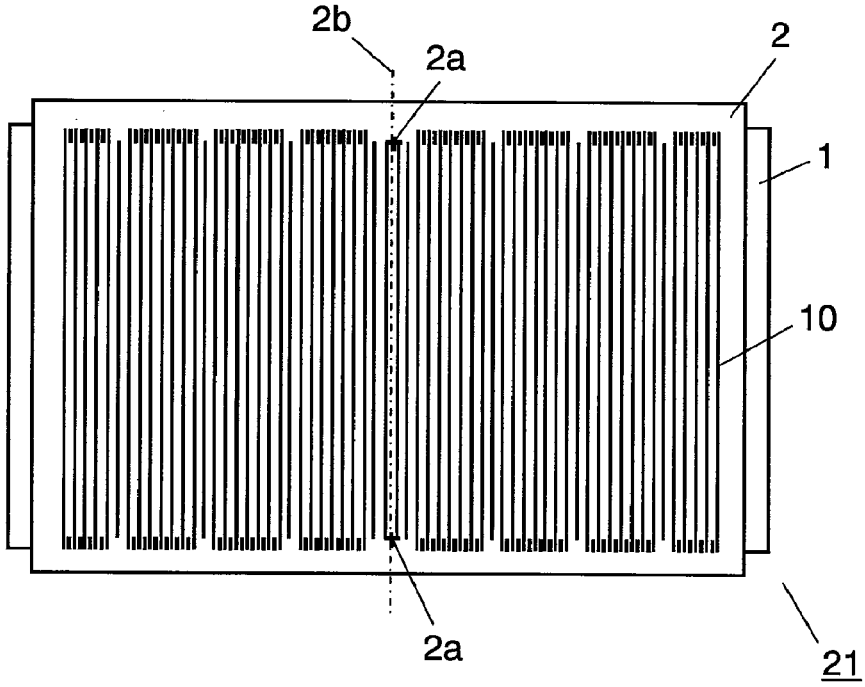
FIG. 12B is a schematic plan view showing the plasma display panel shown in FIG. 12A is viewed from its rear panel.

FIGS. 12A and 12B show plasma display panel 21 according to the second embodiment of the present invention. FIG. 12C shows rear panel 2 used in panel 21 shown in FIGS. 12A and 12B. FIG. 12C is a partial enlarged plan view showing an essential part of rear panel 2, i.e., an X portion which is of the substantially central portion of rear panel 2 shown in FIG. 12A. In rear panel 2 of the second embodiment, barrier rib 11 is also formed at the divided areas separately in the direction Y parallel to data electrode 10. Rear panel 2 of the second embodiment has the configuration in which barrier ribs 11 formed at the divided areas separately have different reflectances between the plural areas. That is, in barrier rib 11 of the second embodiment, barrier ribs 11 formed at the divided areas separately have different optical properties between the plural areas.

Figure 12C:
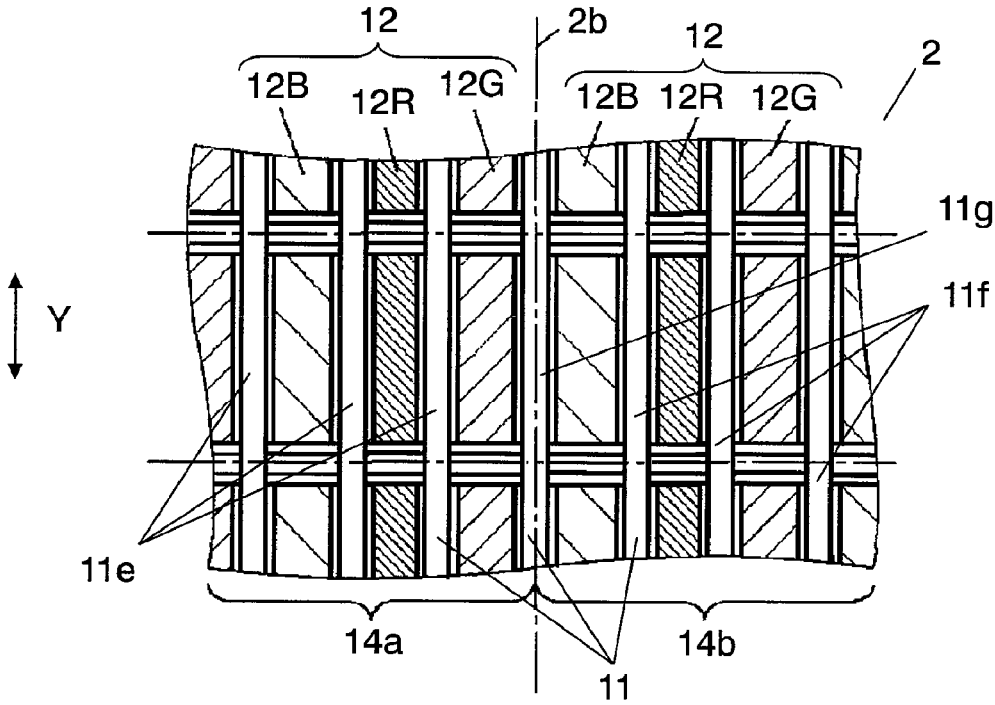
FIG. 12C is a partial enlarged plan view showing an essential part of the rear panel used for the plasma display panel shown in FIG. 12A.

In an example of rear panel 2 shown in FIG. 12C, boundary 2*b* is provided substantially at the center of rear panel 2. In relation to boundary 2*b*, barrier rib 11*e* is formed in left area 14*a* while barrier rib 11*f* is formed in right area 14*b*. A color of barrier rib 11*e* is brighter than a color of barrier rib 11*f*. That is, rear panel 2 is configured such that barrier rib 11*e* of right area 14*a* and barrier rib 11*f* of left area 14*b* differ from each other in the reflectance. The reflectance of barrier rib 11*g* provided in boundary 2*b* may be equal to the reflectance of barrier rib 11*e*, or the reflectance of barrier rib 11*g* may be equal to the reflectance of barrier rib 11*f*. Barrier rib 11*g* may be configured such that the reflectance on the side of left area 14*a* differs from the reflectance on the side of right area 14*b*. That is, rear panel 2 may have the configuration in which the reflectance on the side of left area 14*a* of barrier rib 11*g* is equal to the reflectance of barrier rib 11*e* while the reflectance on the side of right area 14*b* of barrier rib 11*g* is equal to the reflectance of barrier rib 11*f*. The color of barrier rib 11*f* may be brighter than the color of barrier rib 11*e*.

As described above, in forming rear panel 2 for plasma display panel 21 formed by the divided exposure method, barrier rib 11 is formed at the divided areas separately in the direction Y parallel to data electrode 10. Barrier ribs 11 formed at the divided areas separately have the different reflectances between the plural areas. Therefore, in watching plasma display apparatus 63, boundary 2*b* is hardly recognized by the human eyes, and plasma display panel 21 in which predetermined display quality is maintained is easily realized. Large-screen, high-resolution plasma display apparatus 63 in which plasma display panel 21 is used is easily realized.

INDUSTRIAL APPLICABILITY

The plasma display panel according to the present invention provides a plasma display panel having a large screen and high resolution in a simple method, and therefore, the panel is useful for composing a display device, such as a plasma display apparatus having a large screen.

The invention claimed is:

1. A plasma display panel, comprising:

a front panel, including:

a front substrate; and a plurality of display electrodes disposed on the front substrate, each of the display electrodes composed of a first electrode and a second electrode opposing each other with a discharge gap therebetween, and a rear panel, including:

a rear substrate facing the front substrate to form a discharge space therebetween;

a plurality of barrier ribs disposed on the rear substrate to divide the discharge space;

a data electrode disposed between the barrier ribs so as to intersect the plurality of display electrodes; and a phosphor layer disposed between the barrier ribs, wherein the plurality of barrier ribs are formed at a plurality of divided areas in parallel to the data electrode by a divisional exposure method, the plurality of divided areas forming a boundary, the boundary being formed substantially at a center of the rear panel, the plurality of barrier ribs have different shapes at the boundary between the plurality of divided areas, and each of the plurality of barrier ribs has a vertex portion, the vertex portions of the barrier ribs on one side of the boundary having a width different from a width of the vertex portions of the barrier ribs on another side of the boundary.

2. The plasma display panel according to claim 1, wherein the boundary is provided substantially at a center of the rear panel, and the plurality of barrier ribs have patterns inclined outwardly from the boundary in respective right and left areas divided by the boundary.

3. The plasma display panel according to claim 1, wherein the boundary is provided substantially at a center of the rear panel, and the barrier rib located at one of right and left areas in relation to the boundary is formed so as to be inclined to the barrier rib at the other area in a pattern shape.

4. The plasma display panel according to claim 1, wherein the barrier rib formed at the divided areas separately has a shape in which a width of the barrier rib in a crosswise direction at the boundary is wider than a width of the barrier rib in the crosswise direction in other portions.

5. A plasma display panel, comprising:

a front panel, including:

a front substrate; and a plurality of display electrodes disposed on the front substrate, each of the display electrodes composed of a first electrode and a second electrode opposing each other with a discharge gap therebetween, and a rear panel, including:

a rear substrate facing the front substrate to form a discharge space therebetween;

a plurality of barrier ribs disposed on the rear substrate to divide the discharge space;

a data electrode disposed between the barrier ribs so as to intersect the plurality of display electrodes; and a phosphor layer disposed between the barrier ribs, wherein the plurality of barrier ribs are formed at a plurality of divided areas in parallel to the data electrode by a divisional exposure method, the plurality of divided areas forming a boundary, the plurality of barrier ribs have different properties at the boundary between the plurality of divided areas, and wherein the barrier ribs formed at the divided areas separately differ from each other in a reflectance at the boundary between the plurality of divided areas.

* * * * *